United States Patent [19]

Dellinger

[11] Patent Number: 4,719,977

[45] Date of Patent: Jan. 19, 1988

[54] METHOD OF DRILLING DEVIATED WELLBORES

[75] Inventor: Thomas B. Dellinger, Duncanville, Tex.

[73] Assignee: Mobil Oil Corporation, New York, N.Y.

[21] Appl. No.: 944,738

[22] Filed: Dec. 22, 1986

[51] Int. Cl.[4] ..... E21B 7/08

[52] U.S. Cl. ..... 175/61; 175/73

[58] Field of Search ..... 175/61, 62, 73, 75, 175/76, 94, 101, 107

[56] References Cited

U.S. PATENT DOCUMENTS

| | | | |
|---|---|---|---|
| 3,587,757 | 6/1971 | Herring | 175/94 |
| 4,212,359 | 7/1980 | Adcock | 175/94 |
| 4,246,975 | 1/1981 | Dellinger | 175/61 |
| 4,431,068 | 2/1984 | Dellinger et al. | 175/61 |
| 4,577,701 | 3/1986 | Dellinger et al. | 175/61 |

FOREIGN PATENT DOCUMENTS

| | | | |
|---|---|---|---|
| 2369412 | 6/1978 | France | 175/61 |
| 0648710 | 2/1979 | U.S.S.R. | 175/61 |
| 1150340 | 4/1985 | U.S.S.R. | 175/61 |

OTHER PUBLICATIONS

W. R. Garrett and H. M. Rollins, "New Tool Steers Drill Bit", The Oil and Gas Journal, Nov. 9, 1964, pp. 194–199.

*Primary Examiner*—Stephen J. Novosad
*Assistant Examiner*—Terry Lee Melius
*Attorney, Agent, or Firm*—Alexander J. McKillop; Michael G. Gilman; George W. Hager, Jr.

[57] ABSTRACT

Directional drilling is carried out with a rotary drilling tool having a drill string, a drill bit, a drill motor for rotating the drill bit independently of the drill string, an extension sub having both axially contracted and axially extended positions for providing weight to the drill bit when moving from a contracted to an extended position so as to effect a drilling stroke by the drill bit into the wellbore bottom when drilling with the drill bit independently of rotation of the drill string and a relaxation device for removing any excess weight on the drill bit that would otherwise be detrimental to the direction drilling of a deviated wellbore.

11 Claims, 2 Drawing Figures

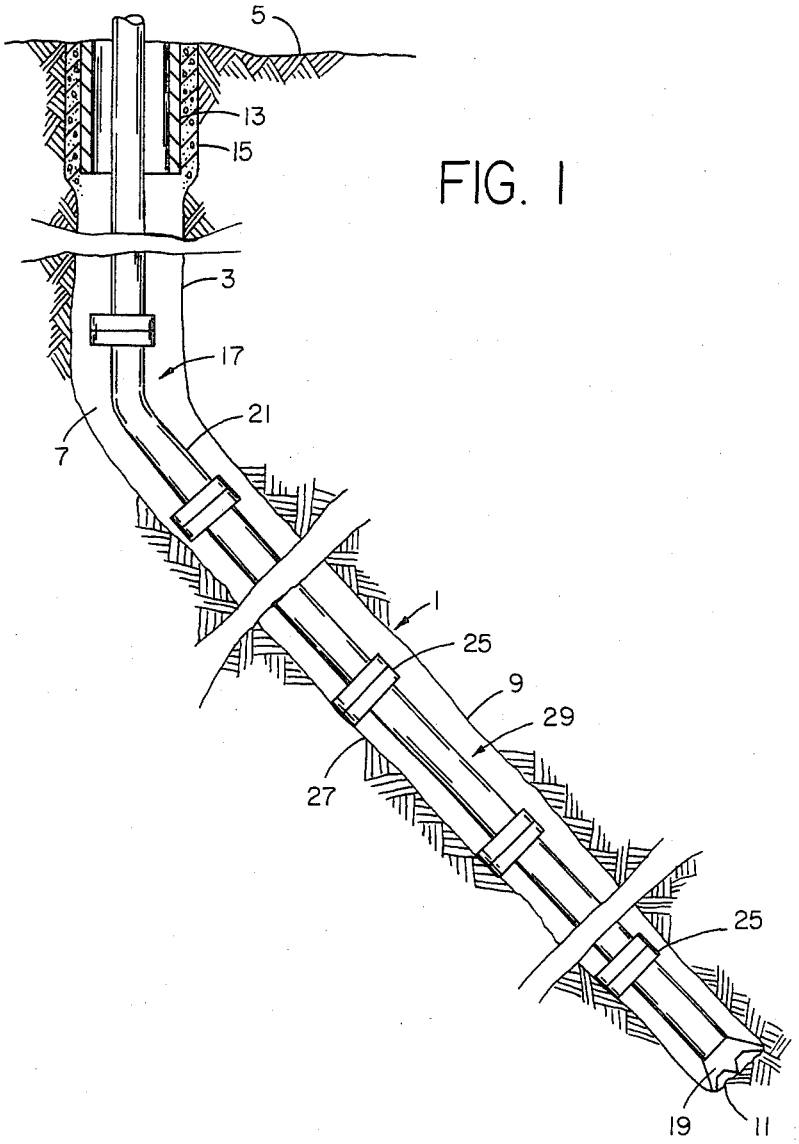
FIG. 1
FIG. 2
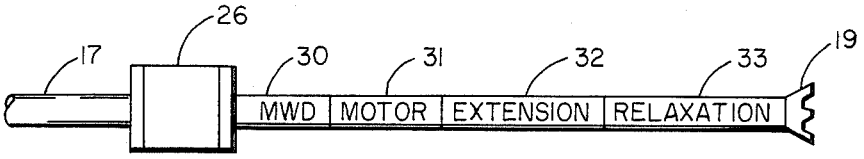

METHOD OF DRILLING DEVIATED WELLBORES

BACKGROUND OF THE INVENTION

The present invention relates to rotary drilling and, more particularly, to a directional drilling technique for providing deviated wellbores at significantly greater inclinations and/or over horizontal distances substantially greater than that currently being achieved by conventional directional drilling practices. The success of such directional drilling should benefit mainly offshore drilling projects as platform costs are a major factor in most offshore production operations. Wellbores with large inclination or horizontal distance offer significant potential for (1) developing offshore reservoirs not otherwise considered to be economical, (2) tapping sections of reservoirs presently considered beyond economical or technological reach, (3) accelerating production by longer intervals in the producing formation due to the high angle holes, (4) requiring fewer platforms to develop large reservoirs, (5) providing an alternative for some subsea completions, and (6) drilling under shipping fairways or to other areas presently unreachable.

A number of problems are presented by high angle directional drilling. In greater particularity, wellbore inclinations of 60° or greater, combined with long sections of wellbore or complex wellbore profiles, present significant problems which need to be overcome. The force of gravity, coefficients of friction, and mud particles settling are the major physical phenomena of concern.

In the rotary drilling of a highly deviated wellbore into the earth, a drill string comprised of drill collars and drill pipe is used to advance a drill bit attached to the drill string into the earth to form the wellbore. As the inclination of the wellbore increases, the desired weight-on-bit for effective drilling from the drill string decreases as the cosine of the inclination angle, and the weight of the drill string lying against the low side of the wellbore increases as the sine of the inclination angle. The force resisting the movement of the drill string along the inclined wellbore is the product of the apparent coefficient of friction and the sum of the forces pressing the string against the wellbore wall. At an apparent coefficient of friction of approximately 0.58 for a common water base mud, drill strings tend to slide into the wellbore from the force of gravity at inclination angles up to approximately 60°. At higher inclination angles, the drill strings will not lower from the force of gravity along, and must be mechanically pushed or pulled, or alternatively, the coefficients of friction can be reduced.

SUMMARY OF THE INVENTION

In accordance with the present invention, there is provided a method and system for drilling a deviated wellbore into the earth by rotary drilling wherein a drill string is used to advance a drill bit through the earth and a drilling fluid is circulated down the drill string and returned from the wellbore in the annulus formed about the drill string.

A vertical first portion of the wellbore is drilled into the earth from a surface location to a kick-off point by rotating and advancing a drill string and drill bit into the earth. A deviated second portion is initiated at the kick-off point and is drilled by a drill tool comprised of a drill string, a drill bit, a drill motor, an extension sub having both contracted and extended positions for providing weight to the drill bit during movement from its contracted to its extended position, and a relaxation device for removing excess weight on bit prior to drilling.

The drill tool is positioned so that the drill bit is a predetermined distance above the wellbore bottom. A rapid dynamic movement downward is imparted to the drill tool so that the drill bit impacts the wellbore bottom and places the extension sub in its contracted position. This provides an initial bit weight that is then reduced by a relaxation movement so as to remove excess bit weight that would otherwise be detrimental to the drilling operation. A drilling stroke of the drill bit into the earth below the wellbore bottom is then carried out by simultaneously maintaining the drill string stationary, rotating the drill bit under control of the drill motor, and advancing the drill bit under the weight provided by the extension sub in moving from its contracted position to its extended position. Upon completion of the drilling stroke, the drill tool is raised so as to again position the drill bit at the predetermined distance above the wellbore bottom. A new drilling stroke is then initiated.

The imparting of downward movement to the drill tool to place the extension sub in the contracted position includes the high-speed rotation of the drill string, in the order of 150 revolutions per minute, to take advantage of the compound coefficient of friction principle and the rapid lowering of the drill tool from a distance of about 30 feet above the wellbore bottom. A desired initial weight-on-bit is at least 20,000 pounds when the extension sub is stroked from its contracted position and at least 16,000 pounds when in its fully extended position. In one embodiment, the weight is under spring-loaded control. In alternative embodiments, the weight is under hydraulic or compressed gas control.

Should this initial weight-on-bit be excessive, it could cause stalling of the drill motor or could create a reaction torque that would result in a loss of drilling orientation. Such an excess weight is reduced by a relaxation movement between the drill bit and the extension sub. This relaxation movement reduces such weight to an acceptable initial drilling weight before the extension sub is released from its contracted or collapsed position.

BRIEF DESCRIPTION OF THE DRAWINGS

FIG. 1 is a schematic drawing of a deviated wellbore extending into the earth and illustrates one embodiment of a rotary drilling tool utilized in the present invention; and FIG. 2 is a more detailed schematic drawing of the lower portion of the rotary drilling tool of FIG. 1.

DESCRIPTION OF THE PREFERRED EMBODIMENT

This invention is directed to a rotary drilling technique for drilling a deviated wellbore into the earth and, more particularly, to a method and apparatus for supplying a desired weight-on-bit for the effective drilling of the deviated wellbore.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, the drill pipe is always in tension during drilling operations. Drill pipe commonly varies from 3½" to 5" in outside diameter. Drill collars are thick-walled pipe as compared to drill pipe and thus are heavier per linear foot than drill pipe. The drill collars act as stiff members of the drill string. The drill collars are normally installed in the drill string immediately above the bit and serve to supply weight on the bit.

In carrying out rotary drilling techniques, a drilling rig is employed which utilizes a rotary table for applying torque to the top of the drill string to rotate the drill pipe and the drill bit. The rotary drill table also acts as a base stand on which all tubulars, such as drill pipe, drill collars, and casing, are suspended in the wellbore from the rig floor. A kelly is used as a top tubular member in the drill string and the kelly passes through the rotary table and is acted upon by the rotary table to apply the torque through the drill pipe to the drill bit. Mud pumps are used for circulating drilling fluid or mud intermediate the drilling rig and the bottom of the wellbore. Normally, the drilling fluid is pumped down the drill string and out through the drill bit and is returned to the surface through the annulus formed about the drill pipe. The drilling fluid serves such purposes as removing earth cuttings made by the drill bit from the wellbore, cooling the bit, and lubricating the drill pipe to lessen the energy required in rotation. In completing the well, casing is normally run thereinto and is cemented for the purpose of sealing and maintaining the casing in place.

The drilling of a deviated wellbore is illustrated in U.S. Pat. Nos. 4,431,068 and 4,577,701. A vertical first portion of the wellbore into the earth's crust from a surface location to a kick-off point at about the lower end of the first portion by rotating and advancing a drill string and drill bit into the earth's crust. A deviated second portion of the wellbore is initiated at the kick-off point. Referring more particularly to FIG. 1, there is shown a wellbore 1 having a vertical first portion 3 that extends from the surface 5 of the earth to a kick-off point 7 and a deviated second portion 9 of the wellbore which extends from the kick-off point 7 to the wellbore bottom 11. A shallow or surface casing string 13 is shown in the wellbore surrounded by a cement sheath 15. A drill string 17, having a drill bit 19 at the lower end thereof, is shown in the wellbore 1. The drill string 17 is comprised of drill pipe 21 and the drill bit 19, and will normally include drill collars (not shown). The drill pipe 21 is comprised of joints of pipe that are interconnected together by either conventional or eccentric tool joints 25, as is also illustrated in U.S. Pat. No. 4,246,975, in the vertical first portion 3 of the wellbore extending in the open hole portion thereof below the casing 13 as well as in the deviated second portion 9 of the wellbore. The tool joints 25 in the deviated second portion 9 of the wellbore rest on the lower side 27 of the wellbore and support the drill pipe 21 above the lower side 27 of the wellbore.

In drilling of the deviated wellbore, drilling fluid (not shown) is circulated down the drill string 17, out of the drill bit 19, and returned via the annulus 29 of the wellbore to the surface 5 of the earth. Drill cuttings formed by the breaking of the earth by the drill bit 19 are carried by the returning drilling fluid in the annulus 29 to the surface of the earth. These drill cuttings (not shown) tend to settle along the lower side 27 of the wellbore about the drill pipe 21. The eccentric tool joints 25 resting on the lower side 27 of the wellbore support the drill pipe 21 above most of these cuttings. During drilling operations, the drill string 17 is rotated and the rotation of the eccentric tool joints 25 causes the drill pipe 21 to be eccentrically moved in the wellbore. This movement of the drill pipe 21 tends to sweep the drill cuttings (not shown) from the lower side of the wellbore 27 into the main stream of flow of the returning drilling fluid in the annulus 29, and in particular into that part of the annulus which lies around the upper side of the drill pipe 21, where they are better carried by the returning drilling fluid to the surface of the earth.

Maintaining the desired weight on the drill bit 19 is a serious problem in drilling high-angle wellbores. For example, a drill collar, laying in an 80° deviated wellbore with a zero coefficient of friction has only 17% of its weight available for pushing on the drill bit. A 0.2 coefficient of friction might be expected with oil mud on a sliding smooth surface. At this 0.2 coefficient of friction, the drill collar will not slide from the force of gravity into the 80° wellbore and will not add any weight to the drill bit. The actual apparent coefficient of friction in the axial direction will most likely be greater than 0.2 with a non-rotating drill string, and, by the principle of compound coefficient of friction, be between 0.0 and 0.2 for a rotating drill string. The edges of the non-rotating tool joints and any stabilizers will dig into the wellbore wall, thereby increasing the apparent coefficient of friction in the axial direction. An even greater problem will be maintaining weight-on-bit when directionally drilling with a mud motor without rotation of the drill string since the drill string will provide no weight to the drill bit.

It is, therefore, a specific feature of the present invention to provide a method and apparatus for providing such weight-on-bit when drilling with a mud motor and a stationary drill string. FIG. 2 illustrates such apparatus in detail. Located between the lowermost drill collar 26 and the drill bit 19 are the measuring-while-drilling sub 30, the mud motor 31, the extension sub 32, and the relaxation device 33. Such extension sub 32 is the immediate source of weight on the drill bit 19. It can be powered by hydraulic pressure, compressed gas, mechanical springs, or the like. The extension sub is placed in a contracted position (i.e., compressed) by a rapid dynamic movement downward of the entire drill string 17 by such action as a high-speed rotation, a movement downward from an elevated position, or both simultaneously, until the drill bit 19 strikes the wellbore bottom. On commencement of drilling, the drill bit 19 is advanced or stroked under the weight from the compressed extension sub 32 while the drill string remains stationary. Extension sub 32 may be of the soft spring type or may be of the hydraulic cylinder type wherein pump pressure would cause the extension sub to put weight on the drill bit. For all embodiments of the extension sub, the axial wellbore force reaction to each drilling stroke is the frictional resistance of the drill string against the wellbore wall. Further, it is not necessary that the extension sub 32 be located between the mud motor 31 and drill bit 19 as shown in FIG. 2. It could be located between the mud motor 31 and the measuring-while-drilling sub 30 or, it could be located between the measuring-while-drilling sub 30 and the lowermost drill collar 26.

When using a mud motor as the drill motor 31, the initial weight on the drill bit should not be so large as to be detrimental to the drilling operation. For example, the weight of the drill pipe 21 or the downward stopped momentum of the drill string 17 may be so excessive that too large a starting torque is required for the mud motor to initiate the drilling operation. Also, a reactive torque could be created that would rotate the lower borehole assembly components and thereby cause a loss in the drilling orientation. The problem is overcome in the present invention by removing or alleviating any such excessive weight by the provision of a relaxation device 33 between the drill bit 19 and the extension sub 32. Such a relaxation device 33 can be a hydraulic device, such as a conventional dashpot consisting of a cylinder with a closely fitting piston. As there are no inlet ports on such a cylinder, the impact of the drill bit with the wellbore bottom causes motion of the piston to create a vacuum in the cylinder. This vacuum produces a pull on the piston rod sufficient to dash the piston back to the point from which the vacuum was started. Relaxation devices 33 could also be a spring-type mechanism with a short-term stop on a pin which would release in a matter of seconds after compression. A relaxation movement of a few inches would be sufficient to remove any excession weight on the drill bit.

In carrying out a drilling operation with the apparatus of the present invention, the drill string 17 is raised to a predetermined position above the wellbore bottom 11. The drill string is then rapidly moved downward, preferably with rotation, until the drill bit 19 strikes the wellbore bottom 11 to place the extension sub 32 into a contracted position. Before the drill motor 31 is activated, and the extension sub is released from its contracted position, any excessive weight on the drill bit 19 is removed by movement of the relaxation device 33 a number of inches that is sufficient to alleviate the excess weight. Now the extension sub 32 is released to place weight on the drill bit 19 and the mud motor 31 is activated to turn the drill bit 19 and commence the drilling operation.

At the end of the drilling stroke, when the extension sub 32 is fully extended from its contracted position at the start of the stroke, there is an end-of-stroke indication, for example, a mud pressure increase or decrease. The entire drill string 17 is then drawn up the wellbore and the drill bit 19 repositioned above the wellbore bottom. The procedure is then repeated with the drill string 17 being lowered to compress the extension sub 32 and the drilling stroke being thereafter again completed.

In one example, the drill string 17 is pulled upward until the drill bit 19 is about 30 feet above wellbore bottom. The mud circulation is stopped and the drill string rotation is increased to about 150 rpm. A rapid lowering of the rotating drill string 17 is then initiated to compress the extension sub 32. It is preferred that the compressed extension sub be able to advance the drill bit at least 2 to 4 feet during each drilling stroke with no drilling string advancement. This may be accomplished by an extension sub delivering about 20,000 pounds of weight to the drill bit in the compressed state and about 16,000 pounds in the extended state. In one example, the relaxation device removes any initial excess weight over about 20,000 pounds by providing up to six inches of relaxation movement.

Drill bit 19 is a 12¼ inch bit. Drill motor 31 is 7¾ inch Delta 1000 mud motor supplied by Dyna-Drill Co. of Irvine, Calif., and which is 24½ feet in length. The measuring-while-drilling system 30 can be of the types supplied by The Analyst/Schlumberger of Houston, Tex.; Gearhart Industries of Fort Worth, Tex.; Teleco Oil Field Services of Meriden, Conn.; or Exploration Logging of Sacramento, Calif. Other suitable measuring-while-drilling systems are disclosed in U.S. Pat. Nos. 3,309,656; 3,739,331; 3,770,006; and 3,789,355.

Several alternative embodiments are available for configuration of the extension sub 32. When powered by hydraulic pressure, the teaching of U.S. Pat. No. 3,105,561 to Kellner for a hydraulic actuated drill collar may be utilized. A servo-controlled hydraulic loading ram is disclosed in Report No. C00-4037-3, Aug. 1, 1977, of the Energy Research and Development Administration in an article entitled, "Downhole Drilling Motors: Technical Review". The technology utilized in conventional bumper subs or jars for drilling and fishing operations may also be used. Such bumper subs include the lubricated bumper sub No. 74-23 of Baker Service Tools, the A-Z fishing bumper sub of A-Z International Tool Co., and the fishing bumper sub described in Technical Manual No. 4460 of Bowen. One such bumper jar is the ball bearing drive bumper jar of Driltrol.

While a preferred embodiment of the invention has been described and illustrated, numerous modifications or alterations may be made without departing from the spirit and scope of the invention as set forth in the appended claims.

We claim:

1. A method of drilling a deviated wellbore into the earth by a rotary drilling technique wherein a drill string is used to advance a drill bit through the earth and a drilling fluid is circulated down the drill string and returned from the wellbore in the annulus formed about the drill string, comprising:

(a) drilling a vertical first portion of said wellbore into the earth from a surface location to a kick-off point at about the lower end of said first portion by rotating and advancing a drill string and drill bit into the earth, (b) initiating a deviated second portion of said wellbore at said kick-off point, (c) withdrawing said drill string and drill bit from said vertical first portion of said wellbore, (d) running into said vertical first portion of said wellbore a drill tool for drilling said deviated second portion of said wellbore, said specialized drill tool being comprised of a drill string, a drill bit, a motor for rotating said drill bit, and an extension sub having both contracted and extended positions for providing weight to said drill bit during movement from said contracted to said extended position, (e) positioning said drill tool such that said drill bit is a predetermined distance above the wellbore bottom, (f) imparting both rotation and a rapid dynamic movement downward to said drill tool such that said drill bit impacts the wellbore bottom and places said extension sub in a contracted position, (g) removing excessive weight on said drill bit that would otherwise be detrimental to the drilling of said deviated wellbore prior to said drilling by a relaxation movement of said drilling tool, (h) producing a drilling stroke of said drill bit into the earth below the wellbore bottom by simultaneously maintaining said drill string stationary, rotating said drill bit under the control of said drill motor, and advancing said drill bit under the weight provided by said extension sub in moving from said contracted position to said extended position, (i) raising said drill tool at the end of said first drilling stroke to again position said drill bit a predetermined distance above the wellbore bottom, and (j) repeating steps (f) through (h) so as to provide additional drilling strokes for the drilling of said deviated wellbore.

2. The method of claim 1 wherein said step of imparting downward movement to said drill tool so as to place said extension sub in a contracted position includes the high-speed rotation of said drill string.

3. The method of claim 2 wherein said drill string is rotated at a speed of at least 150 revolutions per minute.

4. The method of claim 1 wherein said drill tool is positioned in step (e) such that said drill bit is at least 30 feet above the wellbore bottom.

5. The method of claim 1 wherein the step of advancing said drill bit under the weight provided by said extension sub includes the stroking of said extension sub from its contracted position to its extended position under hydraulic pressure control.

6. The method of claim 1 wherein the step of advancing said drill bit under the weight provided by said extension sub includes the stroking of said extension sub from its contracted position to its extended position under compressed gas control.

7. The method of claim 1 wherein the step of advancing said drill bit under the weight provided by said extension sub includes the stroking of said extension sub from its contracted position to its extended position under mechanical spring control.

8. The method of claim 1 wherein said extension sub provides at least 20,000 pounds of weight-on-bit when released from its contracted position.

9. The method of claim 8 wherein said extension sub provides at least 16,000 pounds of weight-on-bit in its fully extended position.

10. The method of claim 1 wherein excessive weight on said bit that would be detrimental to the drilling operation is removed by a relaxation movement of about six inches.

11. The method of claim 1 wherein said second portion of said deviated wellbore is drilled at an inclination of at least 60° from the vertical.

* * * * *